US007037069B2

(12) United States Patent
Arnold et al.

(10) Patent No.: US 7,037,069 B2
(45) Date of Patent: May 2, 2006

(54) IMPELLER AND WEAR PLATE

(75) Inventors: Kim M. Arnold, Mansfield, OH (US); Mark L. Kreinbihl, Mansfield, OH (US); David L. Meister, Mansfield, OH (US); David W. Oswalt, Mansfield, OH (US)

(73) Assignee: The Gorman-Rupp Co., Mansfield, OH (US)

( * ) Notice: Subject to any disclaimer, the term of this patent is extended or adjusted under 35 U.S.C. 154(b) by 0 days.

(21) Appl. No.: 10/697,162

(22) Filed: Oct. 31, 2003

(65) Prior Publication Data

US 2005/0095124 A1 May 5, 2005

(51) Int. Cl.
*F01D 25/24* (2006.01)

(52) U.S. Cl. ..... 415/128; 415/173.4; 415/174.4

(58) Field of Classification Search ..... 415/128, 415/127, 170.1, 173.1, 173.3, 173.4, 174.2, 415/174.4, 71, 72; 416/176
See application file for complete search history.

(56) References Cited

U.S. PATENT DOCUMENTS 1,735,754 A 11/1929 Hargis
2,245,035 A 6/1941 Hartman
3,447,475 A 6/1969 Blum
3,984,193 A * 10/1976 Yu ..... 415/228

(Continued)

FOREIGN PATENT DOCUMENTS

CA 2256272 12/1998

(Continued)

OTHER PUBLICATIONS

T Series™ Self-Priming Centrifugal Pumps, The World Leader in Solids Handling Self-Priming Pumps, pp. 1-12.

(Continued)

*Primary Examiner*—Edward K. Look
*Assistant Examiner*—Dwayne J White
(74) *Attorney, Agent, or Firm*—McDermott Will & Emery LLP

(57) ABSTRACT

In one aspect, there is provided a wear plate for use in combination with a centrifugal pump and impeller. The wear plate has a wear surface defined by a substantially flat surface, a truncated conic section, and/or a curvilinear solid of revolution formed by revolving an area bounded by a curve around a center axis of the wear plate, wherein a notch or recess is provided. The notch or recess extends in a first direction perpendicular to a predetermined direction of rotation of an impeller and a second direction crossing against a direction of rotation of the impeller.

50 Claims, 17 Drawing Sheets

U.S. PATENT DOCUMENTS

| | | | |
|---|---|---|---|
| 4,052,133 | A | 10/1977 | Yeater |
| 4,145,008 | A | 3/1979 | Wolford |
| 4,342,538 | A | 8/1982 | Wolford et al. |
| 4,427,336 | A | 1/1984 | Lake |
| 4,527,948 | A | 7/1985 | Addie |
| 4,540,528 | A | 9/1985 | Haegeman |
| 4,575,308 | A | 3/1986 | Corkill |
| 4,676,718 | A | 6/1987 | Sarvanne |
| 4,758,133 | A | 7/1988 | Clark et al. |
| 4,904,159 | A | 2/1990 | Wickoren |
| 4,913,619 | A | 4/1990 | Haentjens et al. |
| 4,932,837 | A | 6/1990 | Rymal |
| 5,011,370 | A | 4/1991 | Sodergard |
| 5,240,372 | A | 8/1993 | Krienke |
| 5,256,032 | A | 10/1993 | Dorsch |
| 5,516,261 | A | 5/1996 | Zelder |
| 6,042,332 | A | 3/2000 | Kochanowski et al. |
| 6,139,260 | A | 10/2000 | Arbeus |
| 6,158,959 | A | 12/2000 | Arbeus |
| 6,464,454 | B1 | 10/2002 | Kotkaniemi |
| 6,468,029 | B1 | 10/2002 | Teplanszky |
| 6,582,191 | B1 | 6/2003 | Addie et al. |
| 6,599,086 | B1 | 7/2003 | Soja |
| 6,799,943 | B1 * | 10/2004 | Racer et al. ..... 415/116 |

FOREIGN PATENT DOCUMENTS

| | | |
|---|---|---|
| CA | 2253067 | 6/2002 |
| CA | 2254187 | 7/2002 |

OTHER PUBLICATIONS

T Series ™ The Best Self-Priming, Solids Handling Trash Pumps Only form Gorman-Rupp.

* cited by examiner

IMPELLER AND WEAR PLATE

TECHNICAL FIELD

The technical field relates to centrifugal pumps, and, more particularly to centrifugal pumps used to pump mixtures of solids and liquids, solids-laden mixtures, and slurries.

BACKGROUND

Centrifugal pumps use centrifugal force to move liquids from a lower pressure to a higher pressure and employ an impeller, typically consisting of a connecting hub with a number of vanes and shrouds, rotating in a volute or casing. Liquid drawn into the center of the impeller is picked up by the vanes and accelerated outwardly by rotation of the impeller toward the periphery of the casing, where it is then discharged at a higher pressure.

Centrifugal pumps are conventionally used in applications involving mixtures of solids and liquids, solids-laden mixtures, slurries, sludge, raw unscreened sewage, miscellaneous liquids and contaminated trashy fluids. These mixed mediums are encountered in industrial or commercial applications including sewage plants, sewage handling applications, paper mills, reduction plants, steel mills, food processing plants, automotive factories, tanneries, and wineries.

The nature of the conveyed medium poses significant challenges to continuous operation of the pumps. Of particular concern is the clogging of the impeller by debris in the pumped medium including but not limited to long rags, fibers, and like debris which are able to wrap around the impeller vanes, stick to the center of the vanes or hub, or lodge within the space between the impeller and the housing. Clogging severely impacts the efficiency of the pump.

U.S. Pat. No. 6,464,454 issued to Kotkaniemi on Oct. 15, 2002, discloses as shown in FIGS. 1(*a*)–(*b*), grooves 4, 16 at an inside wall of housing 1–1A, which extend from the outer outlet channel in the housing along the whole of the part of the wall adjacent to the vanes and some distance further. Kotkaniemi discloses slits 5, 15 provided between a vane and the housing, wherein the slits widen continuously outwards from the shaft in the direction of the flow so as to improve conveyance of fluid and matter therein. However, widening of the clearance between the impeller and wear plate or housing toward the outer diameter of the impeller reduces the efficiency of the impeller, such as by recirculation from the top side of the vane to the underside of the vane. In fact, worn pump impellers typically exhibit wear toward the outer diameter of the impeller, such as provided as the starting point in Kotkaniemi.

U.S. Pat. No. 6,139,260 issued to Arbeus on Oct. 31, 2000, discloses a pump housing comprising feeding grooves 8 in a wear surface opposed to the impeller vanes, as shown in FIG. 2. Arbeus discloses that such grooves 8 cooperate with the leading edges of the vane or vanes in such a way as to feed pollutants in the direction of the pump outlet, as opposed to an attempted disintegration of the pollutant by a cutting means. Groove 8 is shown to extend radially outwardly from an inner edge of the pump housing 7 to an outer edge thereof along the direction of rotation 9 of the impeller. Groove 8 is also shown to continuously widen along its length.

Some pumps designed for handling mixtures of solids and liquids displace the impellers from the wear plate, such as vortex pumps. U.S. Pat. No. 4,575,308 provides a vortex pump configured to minimize or reduce jamming or clogging of the pump by providing a swirl chamber adapted to redirect the pumped liquid thereabout as the impeller is rotated, whereby the liquid and suspended solid materials are formed into a swirling vortex of increased rotational velocity to substantially prevent the solid materials from adversely interfering with the impeller. A significant problem with these designs is that the pumps deliver a relatively low head to the fluid and the efficiency of these pumps is poor. Other pump designs, such as shown in U.S. Pat. No. 4,932,837, favor a closer, but still sizable, clearance between the impeller and the housing. However, the clearance between the impeller vanes and the interior wall of the pump housing is typically one quarter inch or more, which still suffers from reduced head and efficiency. This approach yields a compromise between pumping pressure and efficiency, on one hand, and minimization of pump clogs caused by solid objects jamming between the impeller vanes and the housing, on the other hand.

However, despite the above-noted improvements to pump and impeller design, additional structural and performance improvements may yet be realized.

SUMMARY

In one aspect, there is provided a wear plate for use in combination with a centrifugal pump and impeller. The wear plate has a wear surface defined by a substantially flat surface, a truncated conic section, and/or a curvilinear solid of revolution formed by revolving an area bounded by a curve around a center axis of the wear plate, wherein a notch or recess is provided. The notch or recess extends in a first direction perpendicular to a predetermined direction of rotation of an impeller and a second direction crossing against a direction of rotation of the impeller.

In another aspect, there is provided a centrifugal pump impeller, comprising at least one vane disposed on the impeller and a flange provided at a working surface of the vane to form at least a portion of an impeller to wear plate interface and extending toward a high-pressure side of the vane. In various other aspects, the vane comprises a curvilinear and continuous vane extending from one edge of the centrifugal pump impeller through a central portion of the impeller to another opposing edge of the impeller and may be symmetric.

A further aspect includes a centrifugal pump, comprising an impeller configured to rotate in a predetermined direction of rotation within the centrifugal pump, a wear plate bearing a wear surface disposed opposite and adjacent the impeller, and a notch or recess provided in the wear surface, wherein the notch or recess extends in a first direction perpendicular to predetermined direction of rotation of the impeller or a second direction crossing against a direction of rotation of the impeller.

Yet another aspect includes a centrifugal pump, comprising: an impeller configured to rotate in a predetermined direction of rotation within the centrifugal pump, the impeller having at least one vane; and a wear plate bearing a wear surface disposed opposite and adjacent the impeller, and one of a notch and recess having a first width provided in the wear surface. In this aspect, the notch or recess extends in a first direction perpendicular to predetermined direction of rotation of an impeller, a second direction having a component crossing against a direction of rotation of the impeller, and/or a third direction having a component in a direction of rotation of the impeller, under the further condition that the vane comprises a flange provided at a working surface of the vane to form at least a portion of an impeller to wear plate interface having a second width greater than the first width and extending toward a high-pressure side of the vane.

In still another aspect of the present concepts, there is provided a centrifugal pump impeller comprising at least one vane disposed on the impeller, the vane comprising a curvilinear and continuous vane extending from one edge of the centrifugal pump impeller through a central portion of the impeller to another opposing edge of the impeller, and wherein a leading edge of the curvilinear and continuous vane has, at least in a vicinity of the central portion of the impeller, a substantially constant thickness, wherein the vane is symmetric, and wherein a height of the leading edge relative to a bottom of the impeller increases continuously from an outer radius of the leading edge to the central portion of the impeller.

Additional advantages will become readily apparent to those skilled in this art from the following detailed description, wherein only preferred examples of the present concepts are shown and described. As will be realized, the disclosed concepts are capable of other and different embodiments, and its several details are capable of modifications in various obvious respects, all without departing from the spirit thereof. Accordingly, the drawings and description are to be regarded as illustrative in nature, and not as restrictive.

BRIEF DESCRIPTION OF THE DRAWINGS

Reference is made to the attached drawings depicting, in part, examples of the concepts presented herein and wherein elements having the same reference numeral designations represent like elements throughout, and wherein.

DETAILED DESCRIPTION

With reference to the attached drawings, there is described improved configurations of centrifugal pump impellers, a centrifugal pump wear plates, and combinations of centrifugal pump impellers and wear plates.

Figure 1A:
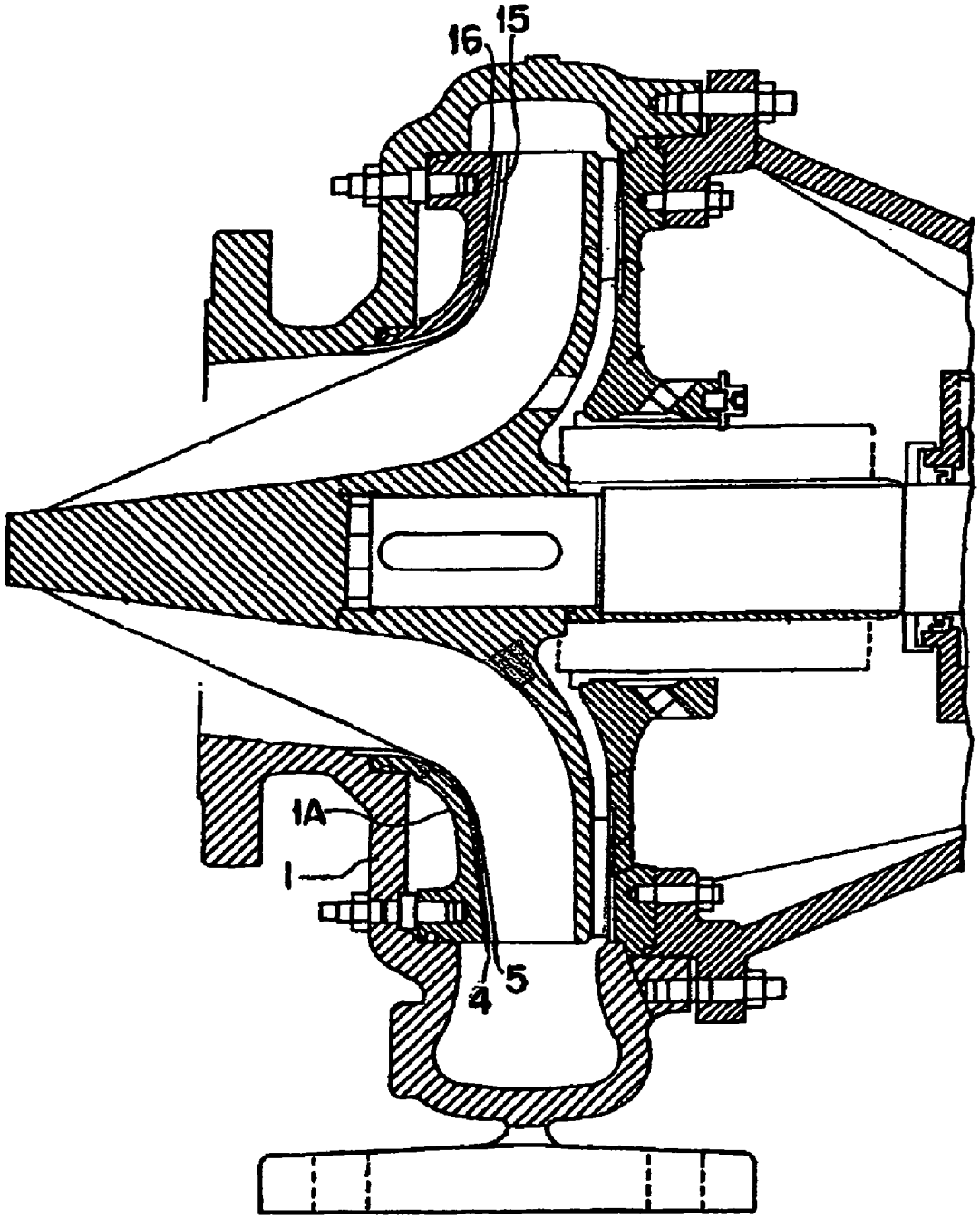
FIGS. 1(*a*)–(*b*) are a cross-sectional side view and an enlarged side view of a conventional centrifugal pump including a groove in the housing.
Figure 1B:
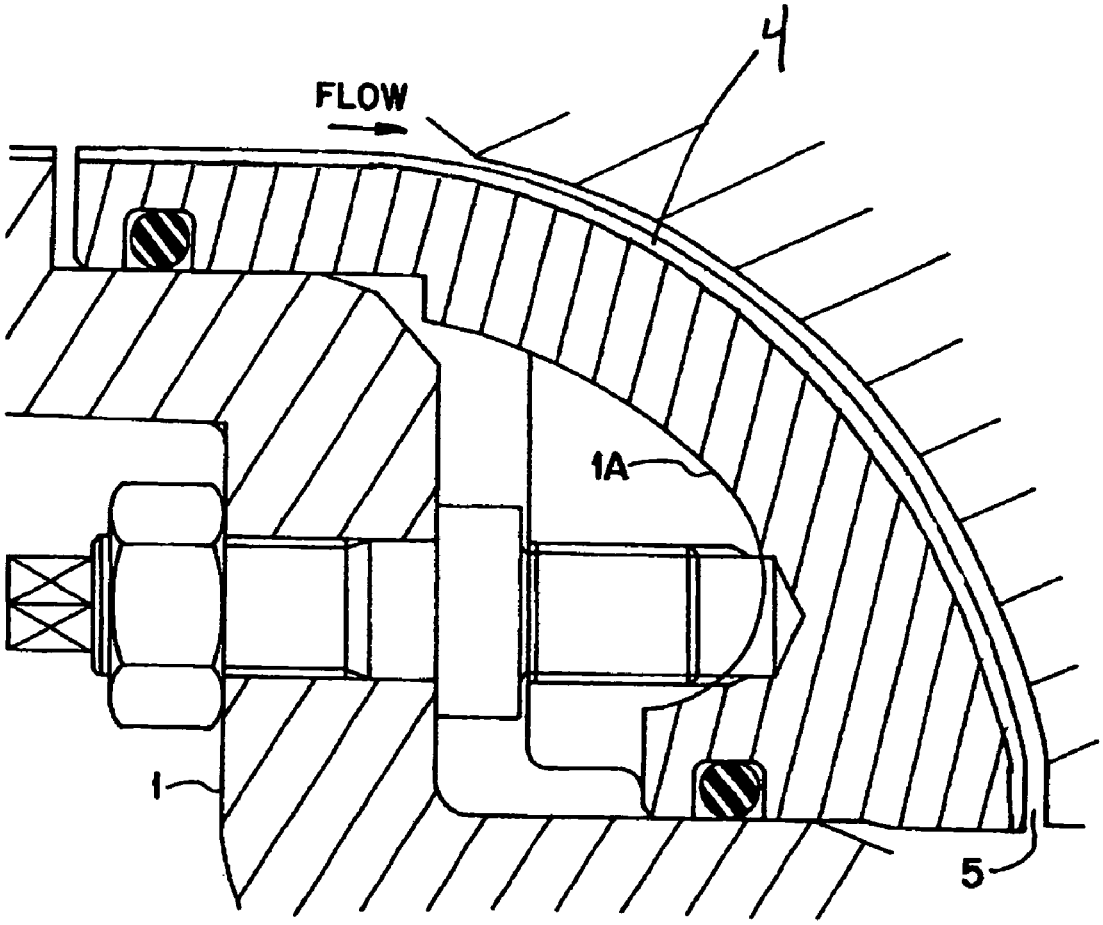
Figure 2:
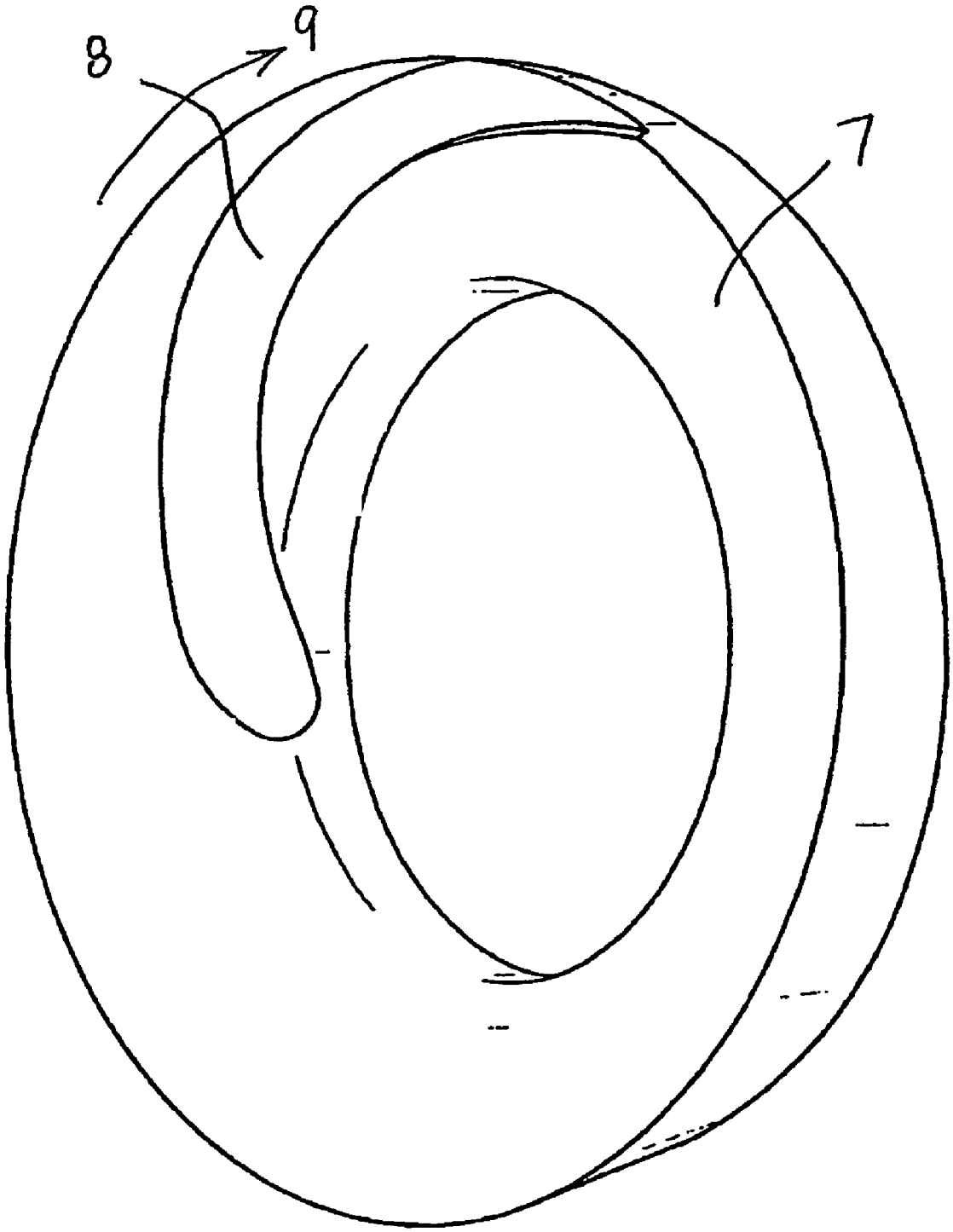
FIG. 2 shows an isometric view of a conventional wear plate notch.
Figure 3:
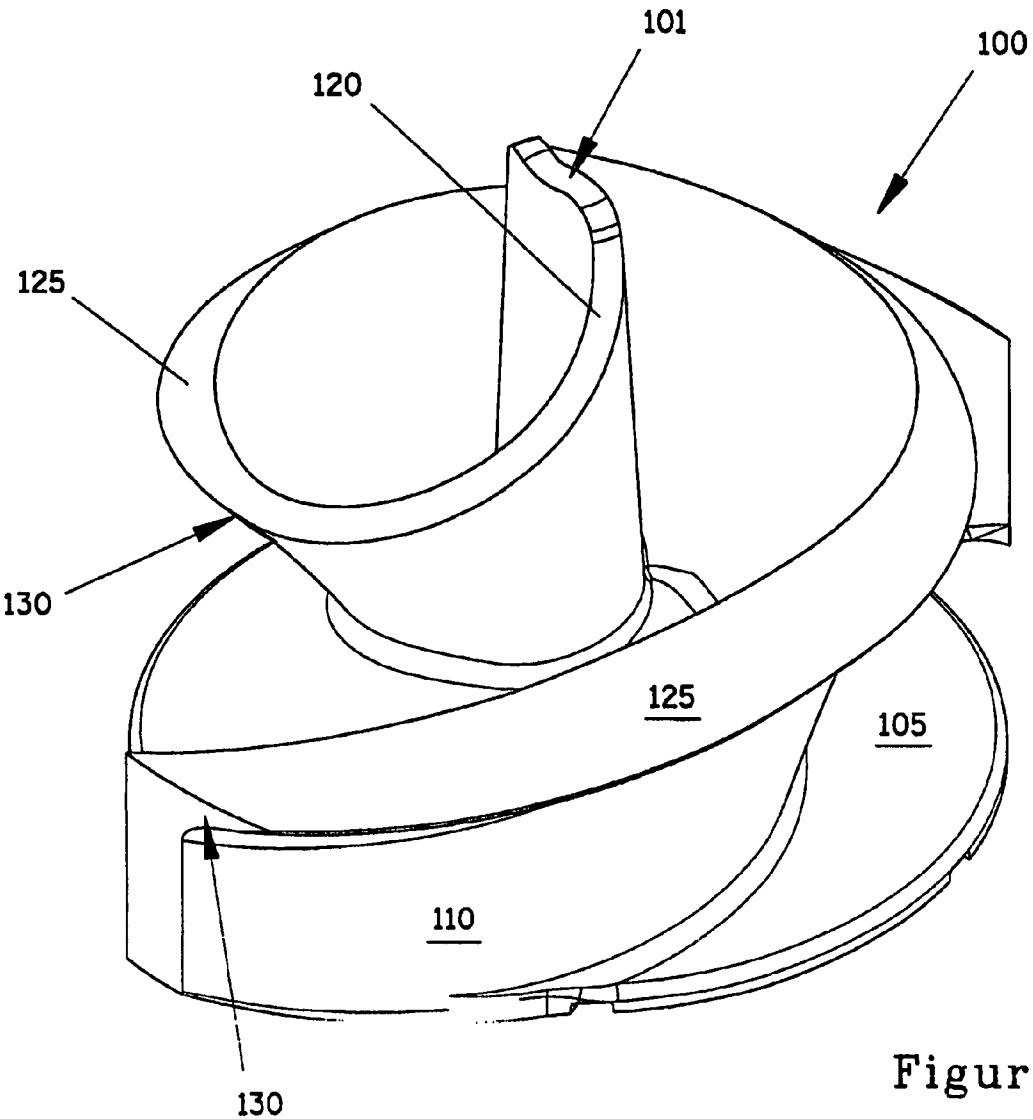
FIGS. 3(*a*)–3(*e*) respectively show isometric, top, first side, second side views of an impeller with a continuous vane and a top view of a combined impeller and wear plate in accord with the present concepts.
Figure 3:
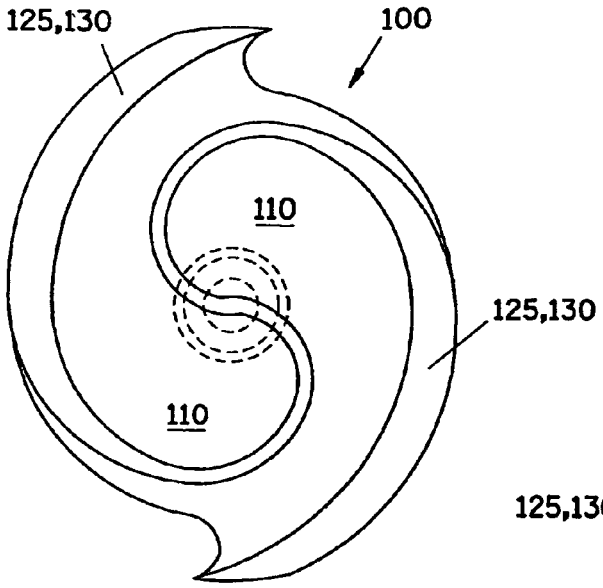
Figure 3:
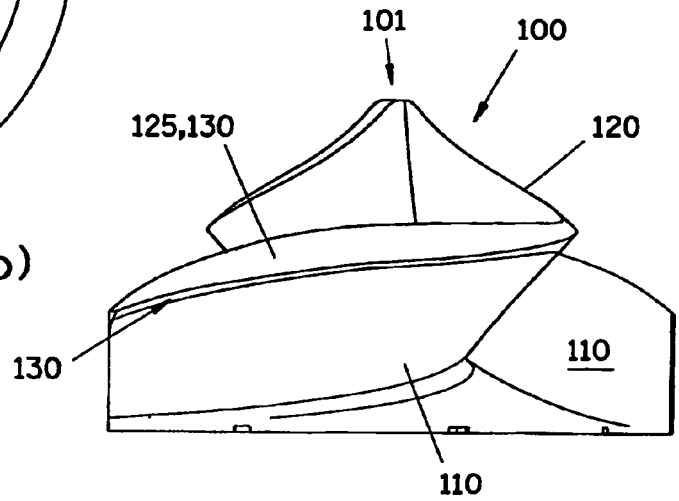
Figure 3:
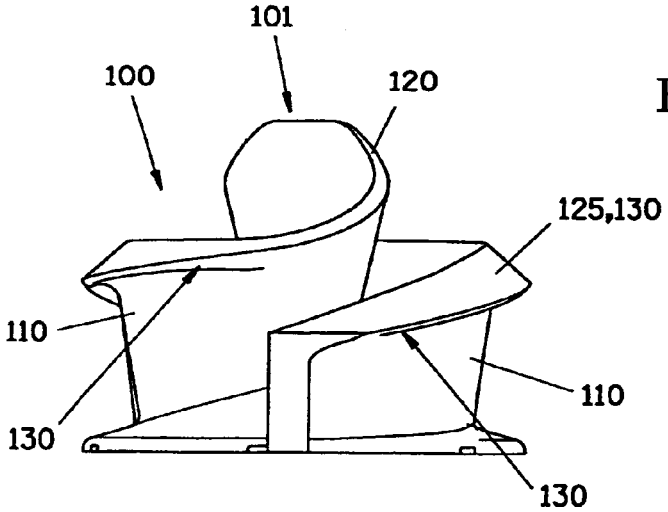
Figure 3:
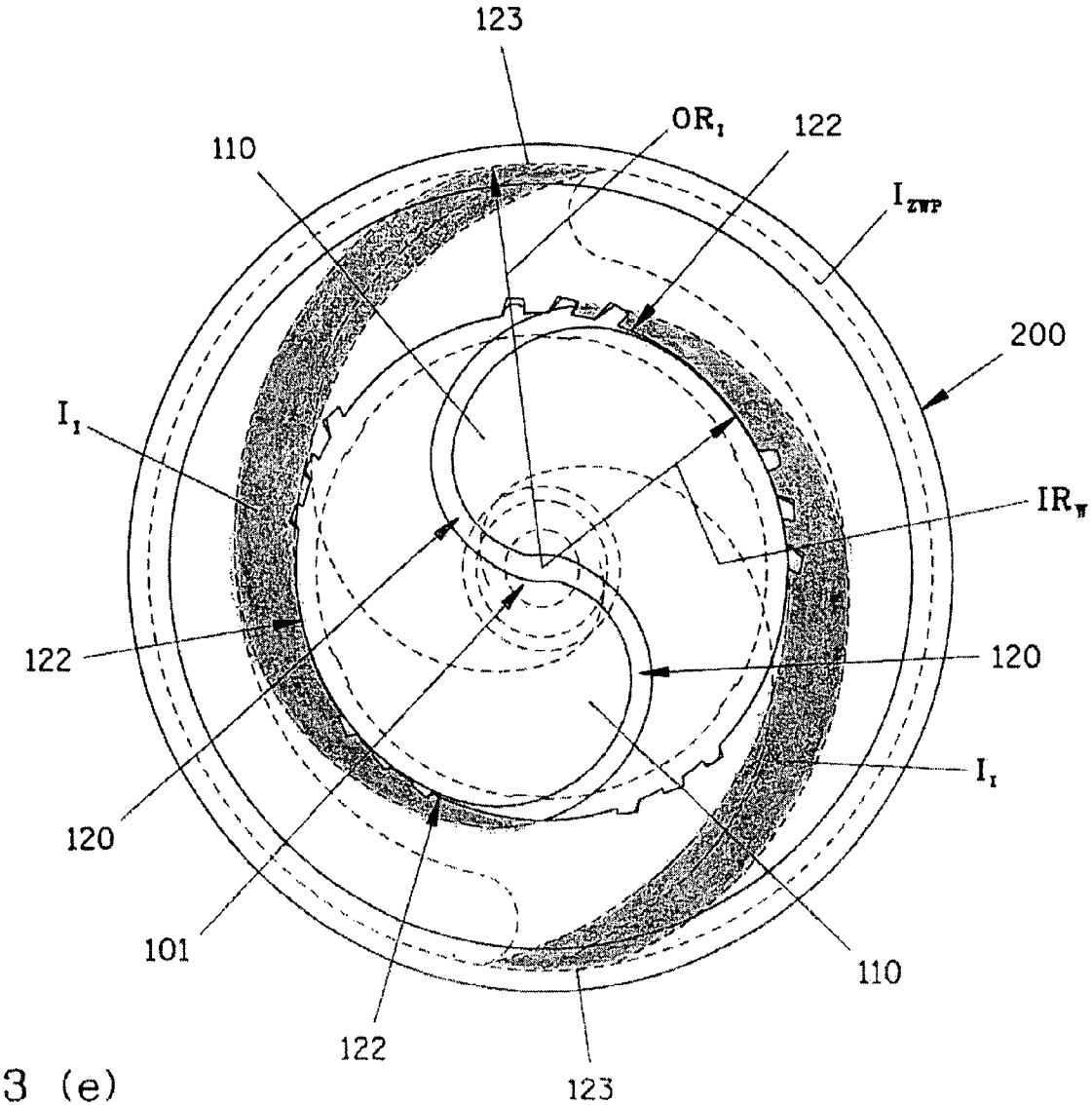

In one aspect, FIG. 3(*a*) shows an isometric view of an impeller 100 with a continuous vane 110 in accord with the concepts described herein. The leading edge 120 of impeller 100 extends into and through an eye of a corresponding wear plate, an exemplary wear plate 200 being shown for example in FIG. 7(*a*), and extends outwardly therefrom, as shown for example in FIGS. 8(*a*)–(*d*). As shown in FIGS. 3(*a*) and 3(*c*), the top 101 of the impeller 100 may be advantageously slightly truncated or flattened without adversely impacting the pumping or trash handling characteristics of the pump, such as shown in FIGS. 3(*a*)–(*d*), to provide, for example, a good reference point for measuring dimensions and placement of the impeller 100 during the machining thereof.

The continuous vane 110 configuration eliminates the conventional centrifugal pump impeller central hub and correspondingly eliminates clogging of the pump impeller 100 due to retention of flexible solids, such as strings, ropes, rags, plastic bags, and the like, on such impeller hub. To the extent that such solids are lodged momentarily on the leading edge 120 of the impeller 100 vane 110, the rotation of the impeller generates centrifugal forces at the leading edge which helps dislodge flexible solids hanging over the leading edge of the impeller vane, forcing such flexible solids into the liquid flow path. Flexible solids which are not dislodged by the aforementioned centrifugal forces are carried down the slope of the leading edge by the fluid axial flow velocity to encounter the wear plate inner diameter. As described herein, one or more notches and/or recesses are provided in the wear plate, such as at the inner diameter of the wear plate, to dislodge flexible solids on the impeller vane leading edge into the liquid flow path.

With open face impellers, solids in the pumped fluid, such as the flexible solids noted above, have a tendency to follow the high to low pressure flow path across the face of the vane from the top of the vane to the underside of the vane and have a corresponding tendency to become lodged on the vane at or adjacent the impeller to wear plate interface. As known to those of ordinary skill in the art, the impeller to wear plate interface is the region in which the top portion of an impeller vane (e.g., 110) is adjacent (or would be adjacent) to a corresponding wear plate 200 inner or wear surface 201 (see, e.g., FIGS. 9(*a*)–(*h*)).

A top-down view of the impeller to wear plate interface for one static position of the impeller vane 110 is shown by way of example in FIG. 3(*e*), wherein the interface is represented by the shaded portion $I_1$. As the impeller vane 110 rotates, the impeller to wear plate interface would be radially bounded, from the perspective of a 2-D top-down view, by a ring-shaped section $I_{IWP}$ having an outer radius $OR_I$ defined by the distal tip 123 of the impeller vane on the outer side and an inner radius $IR_W$ of the wear plate 200 on the inner side. The beginning or proximal end of the impeller to wear plate interface $I_{IWP}$ is shown to occur at the point represented by reference numeral 122, which depicts the intersection, in the top-down view, between an inner radius $IR_W$ of the wear plate 200 and the vane 110. Solids which become lodged on the vane 110 at or adjacent the impeller to wear plate interface $I_{IWP}$ then heat up, de-water, or pack, causing a build up on the vane, increased impeller drag, and reduced efficiency, and may cause pump seizure or prevent a pump from starting once it is stopped.

In accord with the present concepts includes, a flange or winglet 130 provided on the impeller vane (e.g., 110) so as to widen the top surface of the impeller vane over at least a portion of the impeller to wear plate interface $I_{IWP}$, the region in which the top portion of impeller vane 110 is adjacent (or would be adjacent) to a corresponding wear plate 200 inner or wear surface 201, as noted above. The topmost portion of the impeller vane 110 opposing wear plate 200 wear surface 201 is the working surface 125 of the vane. The working surface 125 may consist of only a conventional vane top surface (i.e., no widening of the vane at a top portion thereof) or may comprise, in accord with the present aspects, a vane top surface having integrated therewith a flange or winglet portion 130, such as shown in FIG. 3(*a*), to increase the area of the working surface. Flange 130 may be provided not only on continuous vanes 110, such as depicted in FIGS. 3(*a*)–3(*d*), but may also be provided on conventional, non-continuous vanes.

The transition between the leading edge 120 and the working surface 125 occurs at the opening/eye or inner diameter (ID) of the wear plate or, in other words, the proximal end of the impeller to wear plate interface $I_{IWP}$ represented by reference numeral 122. Working surface 125 is the portion of the impeller vane 110 disposed (or to be disposed) opposite a wear plate 200 wear surface 201. The working surface 125 comprises one-half (e.g., a lower half) of the impeller to wear plate interface $I_{IWP}$, whereas the portion of the wear plate wear surface 201 disposed opposite to the working surface comprises the other one-half (e.g., an upper half) of the impeller to wear plate interface.

Figure 4:
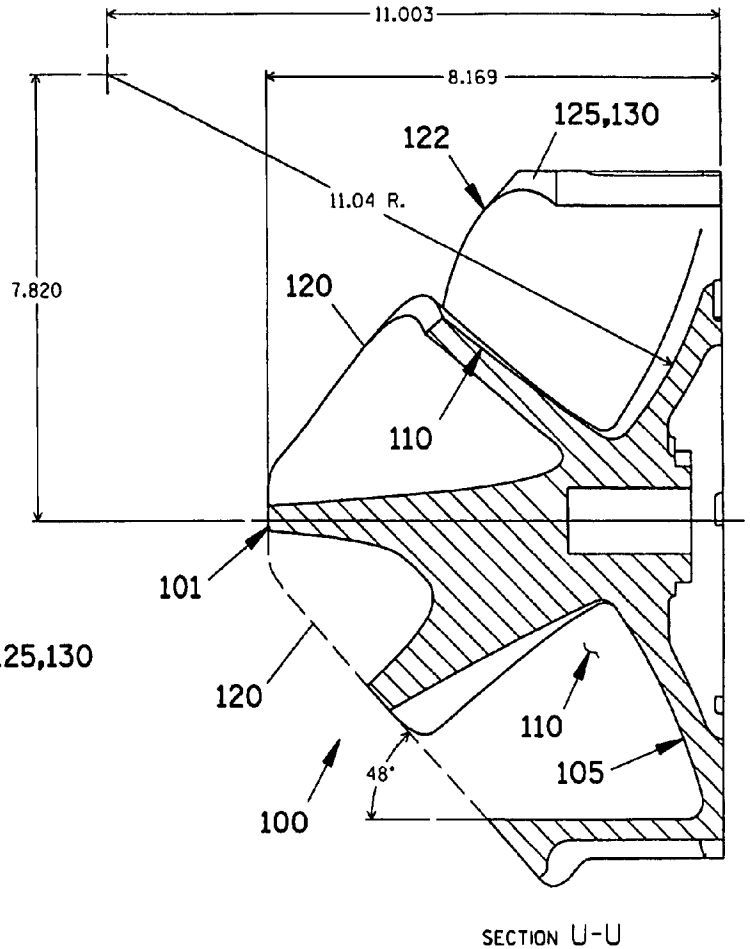
FIGS. 4(*a*)–(*b*) show a top view and a sectional side view, respectively, of the continuous vane impeller depicted in FIGS. 3(*a*)–3(*d*).
Figure 4:
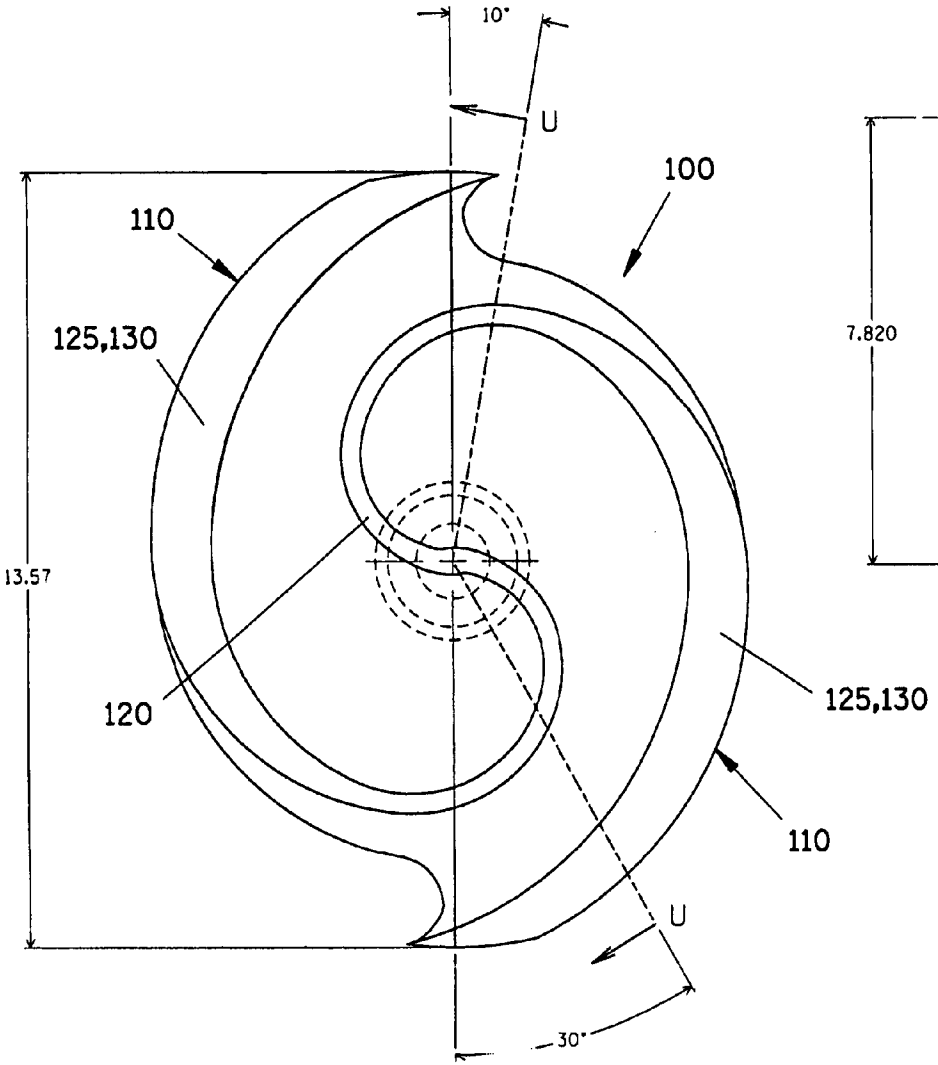

As seen, for example, in FIG. 3(*e*), the leading edge 120 of the vane 110 has, at least in a vicinity of a top/central portion 101 or midpoint of the impeller 100, a substantially constant thickness both at the midpoint and on either side thereof, reflective of a hub-less design in accord with one aspect of the present concepts. Vane 110, which is optionally symmetric, is formed such that a height of top surfaces of the vane (whether it be leading edge 120 portion, working portion 125, or flange portion 130) relative to a bottom of impeller 100 increases continuously between an outer radius $OR_I$ and a top/central region 101 of the impeller, which may be slightly truncated. In accord with such optional truncation, the height at the absolute center of the vane may be equal to the height at points on the leading edge 120 adjacent, such as shown in FIG. 4(*b*). Therefore, the top portion or central region 101, would in one aspect encompass points on the leading edge 120 having, measured from the center of the impeller 100 or vane 110, a radius less than about ⅓ that of the outer radius of the leading edge, and still more preferably, a radius less than about ¼ that of the outer radius of the leading edge.

Widening of the top surface of the impeller vane 110 over at least a portion of the impeller to wear plate interface $I_{IWP}$, such as by provision of flange 130, reduces the apparent differential pressure across the face of the vane and, accordingly, decreases the amount of fluid and/or solid migration to the lower pressure side of the vane. This reduction in the apparent differential pressure is particularly beneficial in configurations wherein the clearance between the impeller vane 110 and the wear plate 200 is close, such as a range of between about 0.005 –0.050 inches and more particularly between about 0.010–0.025 inches, useful in centrifugal pumps, which are required to generate and maintain high differential pressures.

Widening of the vane 110 along the impeller to wear plate interface $I_{IWP}$, such as by provision of a flange 130 or by any other manner of widening of the top surface of the vane in the impeller to wear plate interface region, also increases the distance that any re-circulation has to travel across the face of the impeller vane, thus improving energy efficiency, solids migration, and improving wear characteristics. Widening of the vane 110 along impeller to wear plate interface $I_{IWP}$ further restricts or limits a direct flow path or bleed through from one side of the vane to the other side of the vane, an advantage that is particularly beneficial when such impeller 100 is used in combination with a pump wear plate provided with flow interrupters 210, as described with respect to the example of FIG. 7(*a*).

In the aspect shown in FIG. 3(*a*), the vane 110 includes a flange 130 provided along and forming a part of the vane working surface 125. Flange 130 starts increasing in width at or near the proximal end 122 of the impeller to wear plate interface $I_{IWP}$ and progressively increases in width along the vane in the direction of the distal end 123 of the impeller to wear plate interface over substantially an entire length of the vane. Flange 130 may advantageously narrow toward a distal or outlet end of the vane. Flange 130 may be formed so as to rapidly or gradually achieve a constant width or to gradually increase in width over only a portion of the vane working surface 125. Further, the present concepts encompass any widened working surface 125, no matter what the geometry, including but not limited to an continuous or intermittent widening.

FIGS. 4(*a*)–(*b*) show a top view and a sectional side view, respectively, of a continuous vane impeller 100 such as depicted in FIGS. 3(*a*)–(*d*). The impeller 100 continuous vane 110 has an overall diameter of 13.57 inches, as measured from one distal tip of the vane to the other distal tip of the vane on the opposite end of the impeller.

FIG. 4(*b*) represents a cross-sectional view U—U taken along line U—U in FIG. 4(*a*). The overall profile of the continuous vane 110 in FIG. 4(*b*), comprising the truncated top/central portion 101, has an overall height of about 8.169 inches having, at a top portion thereof, a truncated conic section defining an angle between the side and the axis of rotation of about 48°. Dashed lines depict the conic section that would be traced by the leading edge 120 and the working surface 125 (comprising flange 130) during rotation of the impeller. Reference numeral 122 approximates a location of the beginning or proximal end of the impeller to wear plate interface $I_{IWP}$ at the intersection between an inner radius of vane 110 and a wear plate associated therewith. Reference numeral 122 thus denotes the transition between the vane leading edge 120 and the vane working surface 125, which comprises flange 130.

Figure 5:
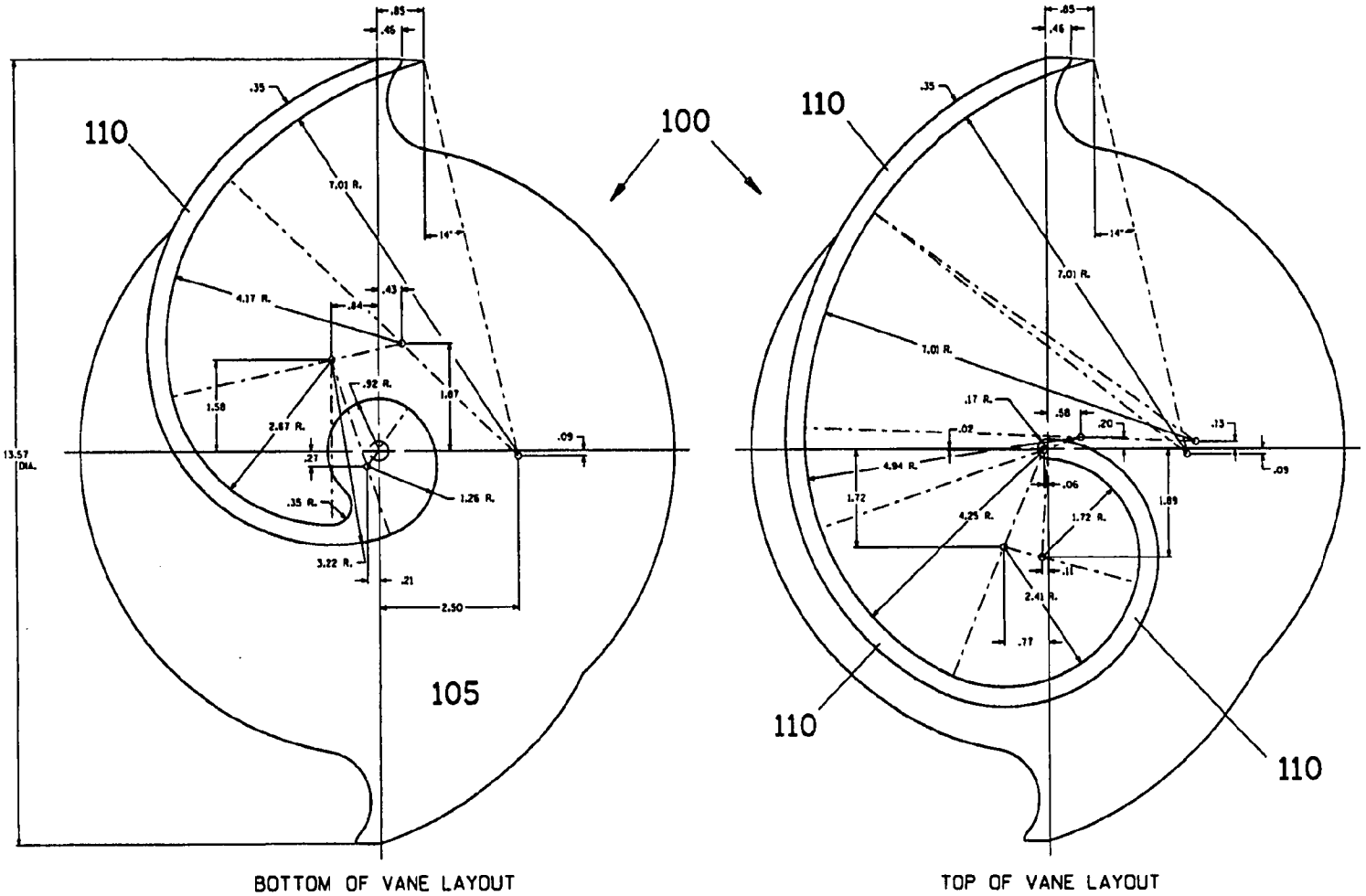
FIGS. 5(*a*)–(*b*) are top-down elevational views of sections of the continuous vane impeller depicted in FIGS. 3(*a*)–3(*d*).

FIGS. 5(*a*)–(*b*) are top-down elevational views of sections of the continuous vane impeller 100 depicted in FIG. 3. FIG. 5(*a*) is a top-down view of the bottom of one-half of the continuous vane 110 where the vane meets the back supporting shroud 105. FIG. 5(*b*) is a top-down view of the top or leading edge 120 and working surfaces 125 of the same one-half of the continuous vane shown in FIG. 5(*a*) with the flange portion 130 removed for clarity.

In one aspect, the vane curvature may be generally defined as a log spiral or a near log spiral, but is certainly not limited thereto. FIG. 5(*a*) shows that the curve followed by the vane 110 bottom follows a progressively smaller radius of curvature toward an inner radius of the vane, wherein a distal or outlet end of the vane is defined by a curved section having a radius of 7.01 inches, a center of the radius being taken at a position, as shown. The bottom of the vane 110 is further defined by, in the depicted example, a second middle curved section having a radius of 4.17 inches at a center point displaced 1.87 inches along a y-axis and 0.43 inches along a x-axis, and second middle curved section having a radius of 2.87 inches at a center point displaced 1.58 inches along a y-axis and −0.84 inches along the x-axis, and a proximal section having a radius of 0.35 inches, as shown.

FIG. 5(*b*) shows that the curve followed by the vane 110 also follows a progressively smaller radius of curvature between the distal or outlet end of the vane and the proximal or center portion of the vane. The distal end of vane 110 is defined by a curved section having a radius of 7.01 inches, a center of the radius being taken at a position, as shown, that is the same as that for the vane 110 bottom. Vane 110 is further defined by, in the depicted example, a fourth middle curved section also having a radius of 7.62 inches at a center point displaced 0.13 inches along a y-axis and slightly outwardly from the initial center radius point along the x-axis. A third vane portion is defined by an arc having a radius of 4.94 inches at a center point displaced 0.20 inches along a y-axis and 0.58 inches along the x-axis. Also provided in the illustrated example are a second middle curved section having a radius of 4.25 inches at a center point displaced −0.02 inches along a y-axis and −0.06 inches along the x-axis, a first middle curved section having a radius of 2.41 inches at a center point displaced −1.72 inches along a y-axis and −0.77 inches along the x-axis, and a proximal section having a radius of 1.72 inches at a center point displaced −1.89 inches along a y-axis and −0.11 inches along the x-axis. The geometry of the example depicted in FIGS. 5(*a*)–(*b*) is only one example of a continuous vane in accord with the present concepts and the concepts expressed herein are not limited thereby.

Figure 6:
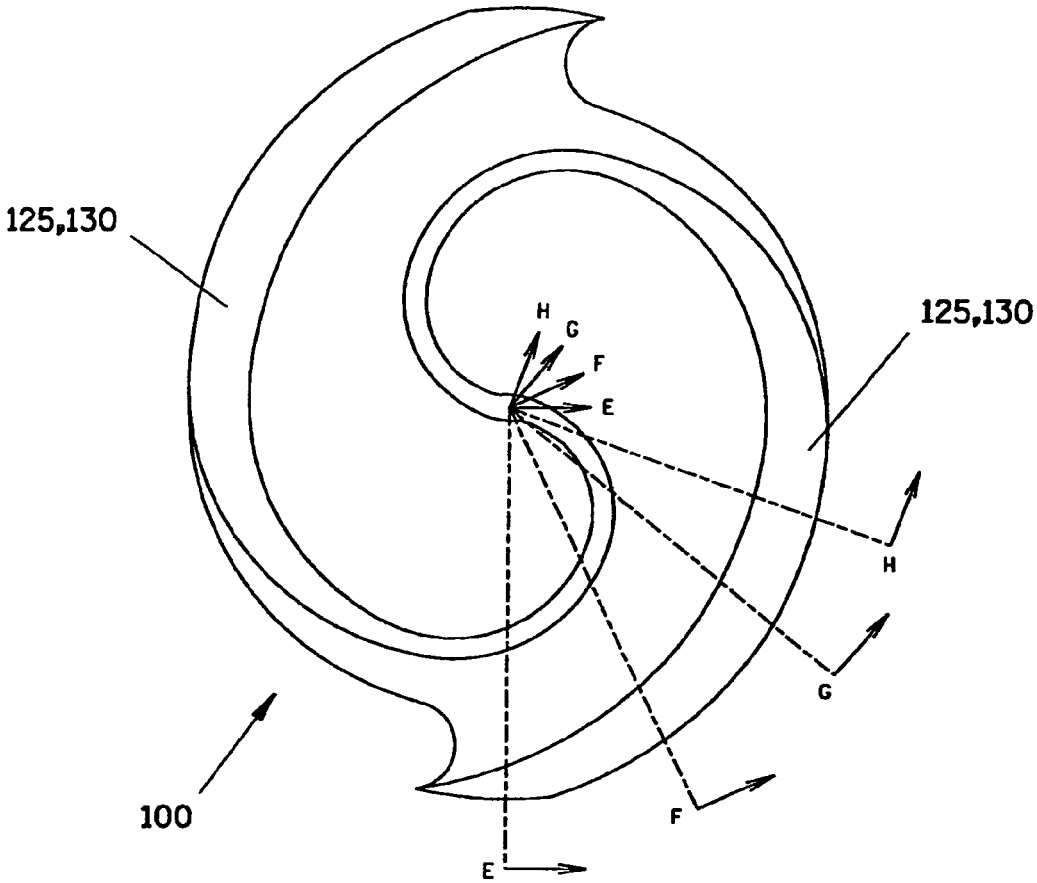
FIGS. 6(*a*)–6(*f*) are, respectively, a top view of the continuous vane impeller depicted in FIGS. 3(*a*)–3(*d*), showing sectional lines taken along sections E—E, F—F, G—G, and H—H, the cross-sectional views taken along such sections, and an enlarged cross-section of a portion of the view of FIG. 6(*c*) shown in combination with a wear plate.
Figure 6:
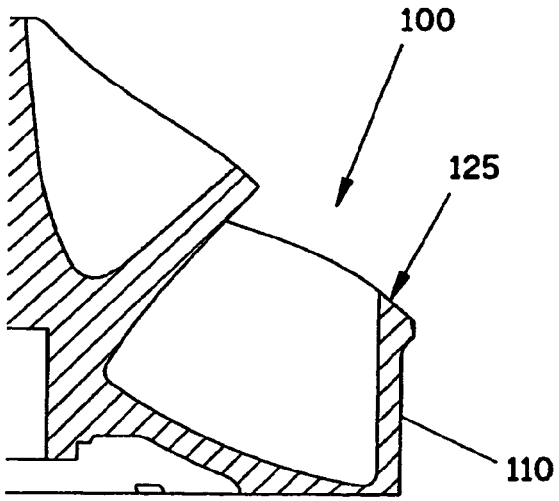
Figure 6:
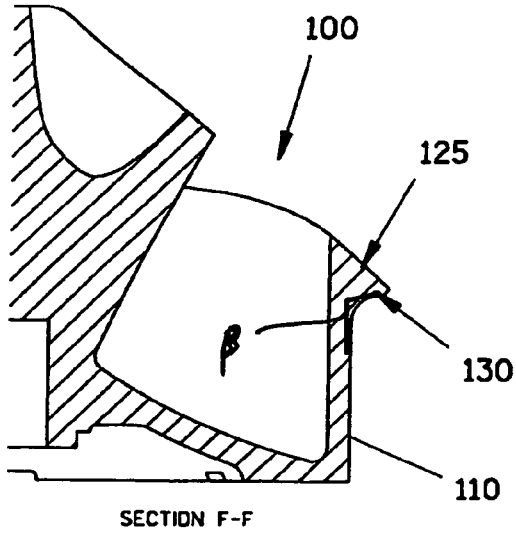
Figure 6:
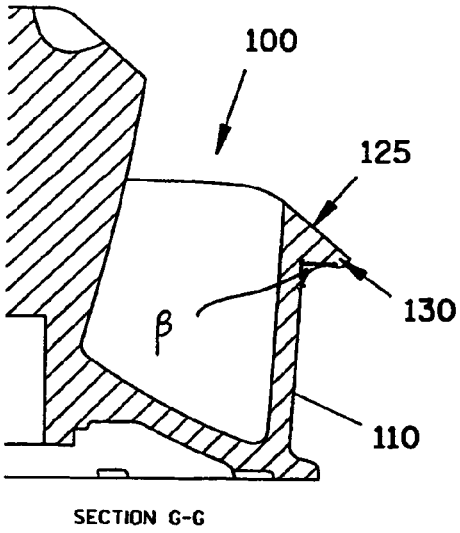
Figure 6:
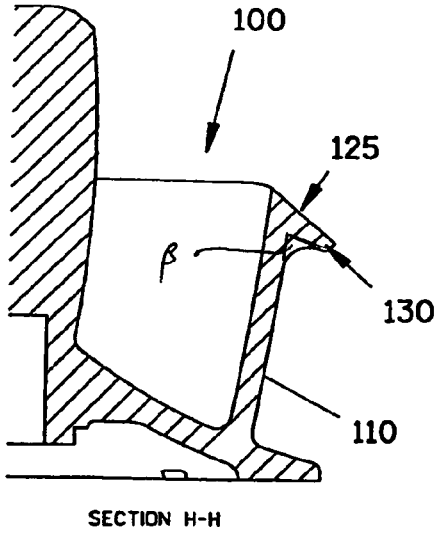
Figure 6:
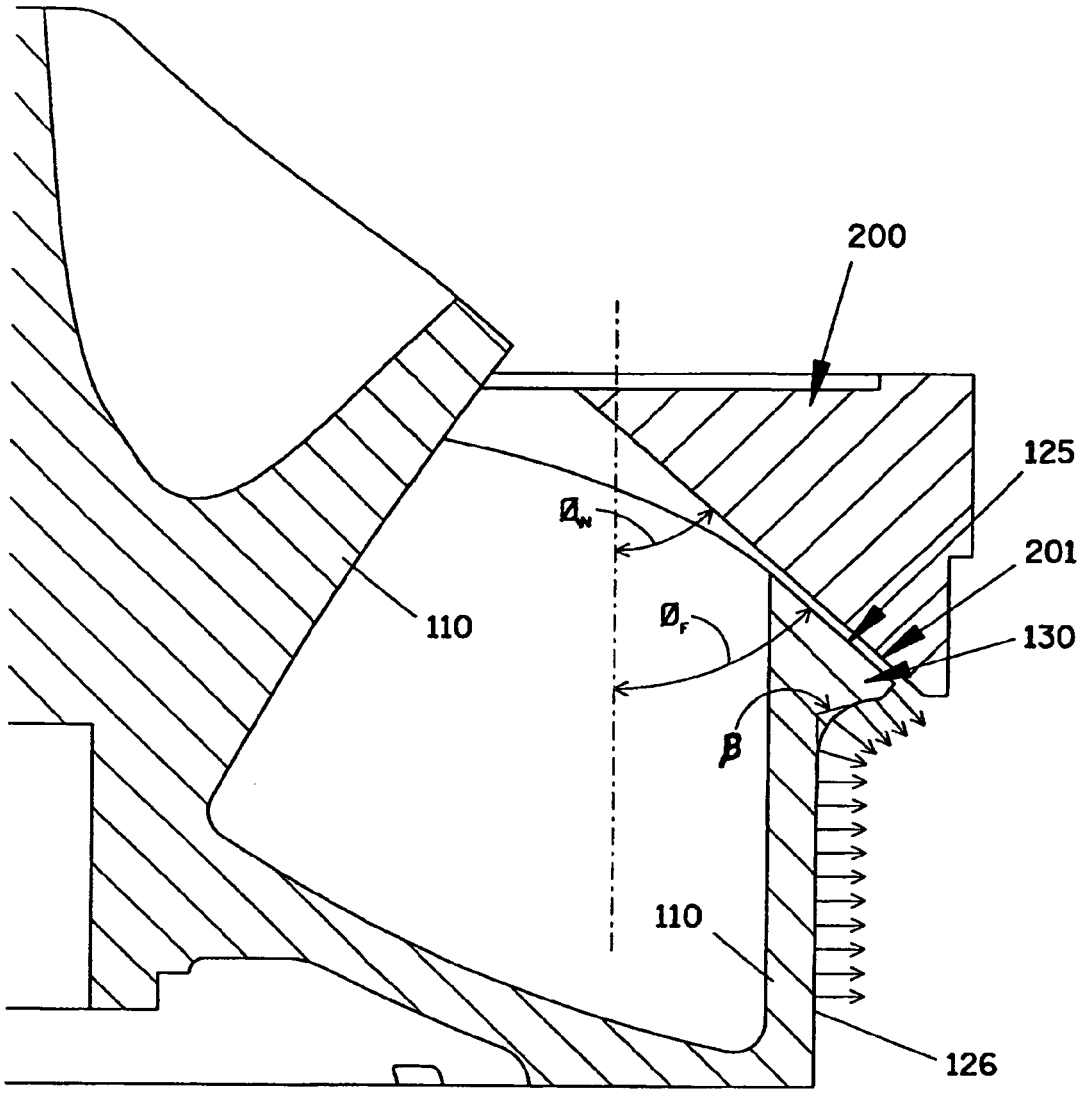

FIG. 6(*a*) is a top-down view of a portion of impeller 100 showing sections E—E, F—F, G—G, and H—H, depicted in FIGS. 6(*b*)–6(*e*). Cross-section E—E is taken at an outlet of the impeller and cross-sections F—F, G—G, and H—H are taken at progressively inward locations in the impeller. FIG. 6(*b*)–6(*e*) shows a flange portion 130, of varying degrees, depending from the vane 110 and comprising a portion of the working surface 125.

As shown in the cross-sectional view of FIG. 6(*f*), which is an enlarged-view of FIG. 6(*c*), a front face of the working surface 125, which includes flange 130, angled away from the impeller 100 axis of rotation in a direction of flow at an angle $\phi_F$ substantially equal to if not equal to an angle $\phi_W$ of an opposing wear plate 200. The correspondence between $\phi_F$ and $\phi_W$ maintains a clearance between the opposing surfaces of the wear plate and impeller vane 110 of, between about 0.005–0.050 inches and, more preferably, between 0.010–0.025 inches, in accord with the concepts herein. If the wear surface 201 defined by the wear plate 200 is substantially linear along a longitudinal axis thereof, such as a wear surface defined by a conic section or a wear surface in the shape of a plate, then $\phi_F$ and $\phi_W$ are substantially constant over respective longitudinal axes thereof. If the wear surface defined by the wear plate 200 is curved, such as a wear surface defined by a curvilinear solid of revolution formed by revolving an area bounded by a curve around a center axis of the wear plate, then $\phi_F$ and $\phi_W$ will vary together accordingly. Moreover, the wear surface is not limited to a single form and may comprise at least one of a substantially flat surface, a truncated conic section, and a curvilinear solid of revolution formed by revolving an area bounded by a curve around a center axis of the wear plate.

Although the angle $\phi_F$ of the vane working surface 125 and/or front face of the flange 130 is fixed to the angle $\phi_W$ of the wear plate 200 wear surface 201 in opposition thereto to maintain a narrow gap therebetween, the angle β between the side working surfaces 126 of the vane 110 and the rear face of flange 130 is independently variable. For simplicity of reference, the angle β in the depicted example may be thought of as the angle defined between a first line parallel to the vane along the axis of rotation of the impeller and a line second drawn tangent to a point of inflection of the underside of flange 130 where the curvature changes from convex to concave to intersect the first line (i.e., the origin). For other flange configurations, the underside of the flange may present a substantially planar surface (e.g., a chamfered bottom surface or a curved surface having a substantially flat portion) from which an extension thereto may be used to define one extent of angle β. In the impeller vane 110 depicted in FIGS. 6(*a*)–6(*e*), the angle β is slightly greater than 90° in FIG. 6(*c*), about 90° in FIG. 6(*d*), and slightly less than 90° in FIG. 6(*e*). Angle β may be uniform over a whole or a part of the length of the vane 110 or may vary over a length of the vane.

Angle β, which would represent a chamfered or angled surface, is advantageously softened by providing the intersection between the side working surfaces 126 of the vane 110 and the rear face of flange 130 with a curvilinear profile. This curved profile may include, but is not limited to, a substantially constant radius, a radius that increases over at least an end portion thereof, or a radius that flares outwardly over an end portion thereof. The curvature of the rear face of flange 130 is provided to influence the flow of solids away from the impeller to wear plate interface $I_{IWP}$. As the impeller vane rotates, the curved rear face of flange 130 will change the direction of solids that are moving in a direction toward the impeller to wear plate interface $I_{IWP}$ away from the impeller to wear plate interface. This change in direction may be slight (e.g., about 1°), moderate (e.g., about 90°), or significant (e.g., about 180°), which corresponds to an angle β of about 179°, 90°, and 0°, respectively, as defined. In other words, the angle β may range from 180° to 0°, inclusive. Preferably, angle β would range from about 130°–50°, and still more preferably from 110°–70°.

Still further, other configurations of continuous vanes, or even non-continuous vanes, may be provided, with or without flanges, in combination with the examples of wear plates described below.

The wear plate 200 in accord with the present concepts is provided with a flow interrupter 210, which may take the form of one or more recesses or notches. The term notch is used herein to refer to an opening in the wear plate 200 and/or wear plate wear surface 201, the opening being defined by any geometric shape and extending through a thickness of the wear plate and/or the wear plate wear surface in at least a portion of the opening, whereas the term recess is used herein to refer to an opening in the wear plate 200 and/or wear plate wear surface 201, the opening being defined by any geometric shape, which does not extend through a thickness of the wear plate and/or the wear plate wear surface over any portion of the opening. The walls of the flow interrupter(s) 210 may comprise sidewalls that are vertical or perpendicular to the surface of the wear plate 200 or wear plate wear surface 201, or may comprise sidewalls that are angled or curved relative thereto.

The flow interrupter 210 interrupts migration of solids between the impeller 100 and the wear plate 200 along the impeller to wear plate interface $I_{IWP}$. Many solids found in waste water, such as plastic products, and vegetation have a tendency to de-water. During pumping, de-watered solids create drag on the driver, but usually allow the pump to keep turning, albeit with diminished performance. However, when the pump stops, the de-watered solids can act like a brake and prevent the pump from starting. The flow interrupter 210 serves to keep the vanes clean during pumping so as to maintain not only a high efficiency, but to enable faster restart.

Figure 7:
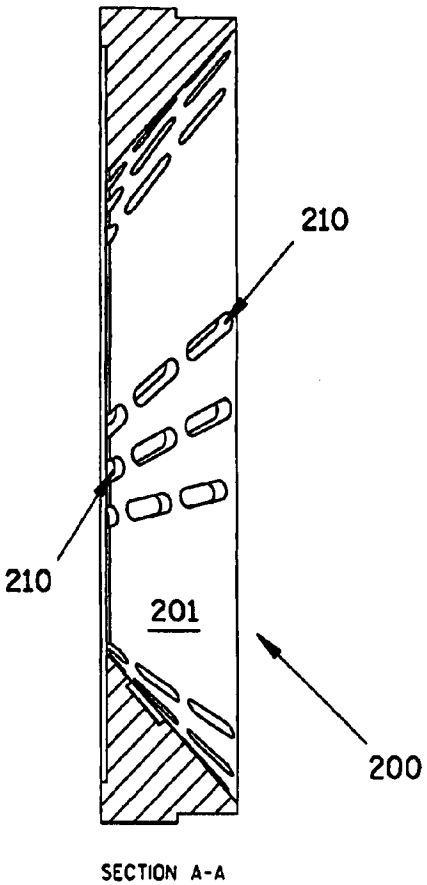
FIGS. 7(*a*)–7(*b*) are, respectively, a top view and a side cross-sectional view of a notched wear plate in accord with the present examples.
Figure 7:
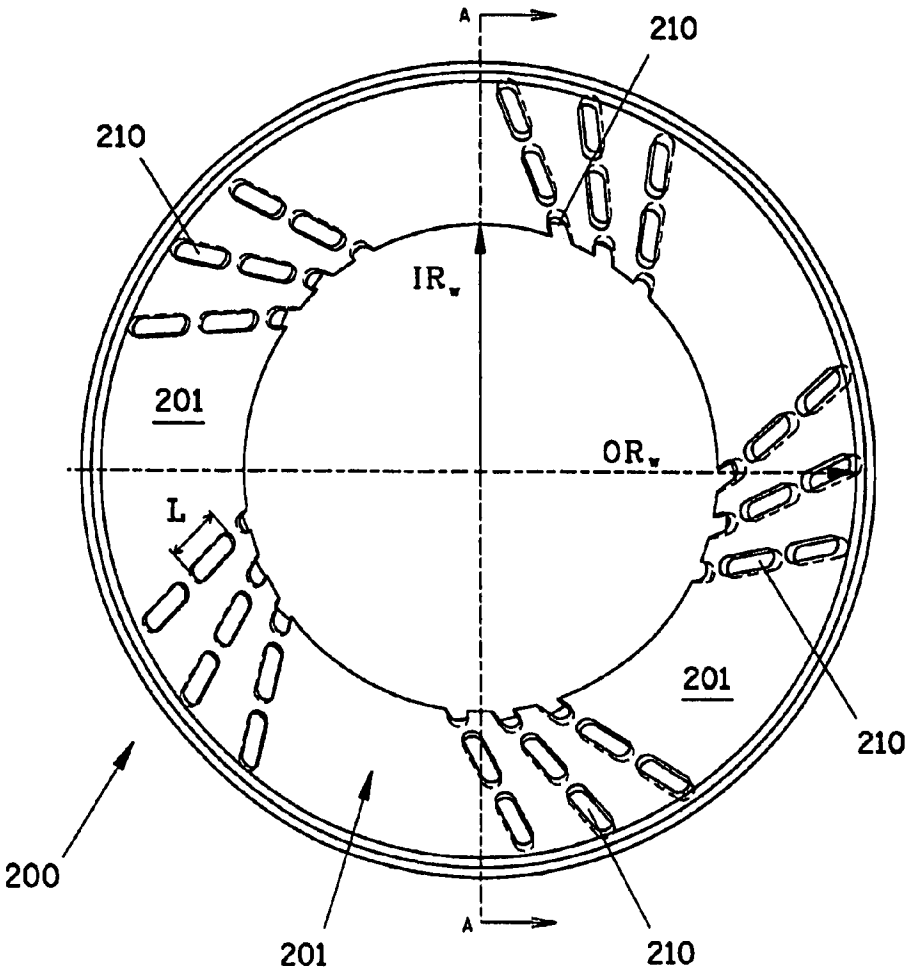

In one example, a wear plate 200 suitable for use in combination with a centrifugal pump and impeller 100 includes a wear surface 201 that forms one side of the impeller to wear plate interface $I_{IWP}$. This wear surface 201 may advantageously be defined by a conic section, such as shown in FIG. 7(*b*) and, more particularly, FIGS. 9(*a*)–(*h*). Alternatively, the wear surface 201 may be defined by a curvilinear solid of revolution formed by revolving an area bounded by a curve around a center axis of the wear plate 200 or even by a flat surface (i.e., a flat wear plate, such as used in smaller pumps).

At least one flow interrupter 210, in the form of one or more notches and/or recesses in the example depicted in FIGS. 7(*a*)–(*b*), are provided in the wear plate 200 so as to extend along the wear plate wear surface 201 a first direction perpendicular to predetermined direction of an rotation of impeller 100 and/or a second direction crossing against a direction of rotation of the impeller. The second direction ranges from the first direction up to and including a direction opposite the direction of rotation. In other words, if the direction of rotation of the impeller 100 is clockwise, the first direction would consist of a perpendicular thereto such as represented by the hands of a clock face centered about the clock hand axis of rotation. The second direction would include any direction between such perpendicular which crosses at some angle against a direction of rotation of the impeller 100 and a direction opposite to (e.g., counter-clockwise) the direction of impeller rotation. Significantly, in accord with various examples of the present concepts, flow interrupter(s) 210 are not provided in a direction of rotation of impeller 100, but rather in a direction against the rotation of the impeller or perpendicular thereto.

In one aspect, a single oblong flow interrupter 210, such as a notch or recess, is disposed to extend in the first and/or second direction, noted above, along a longitudinal direction (e.g., front to back or, in the cross-sectional side view of FIG. 7(*b*), from bottom to top) of the wear plate 200 between an inner radius $IR_W$ of the wear plate and an outer radius $OR_W$ and, optionally, from an inner radius of the wear plate to an outer radius of the wear plate. The length of the notch or recess 210 is denoted as "L".

In another aspect, a plurality of (i.e., two or more) notches and/or recesses 210 may be provided to extend along a longitudinal direction (e.g., front-to-back) of the wear plate 200 wear surface 201 in one or both of the aforementioned first and second directions between an inner radius $r_I$ of the wear plate and an outer radius $r_O$. The notches and/or recesses 210 may be of uniform length and/or shape or may comprise dissimilar lengths and/or shapes. For example, a short notch may be provided along the first direction or second direction near the inner radius of the wear plate in combination with a long recess formed adjacent the short notch, the long recess extending from such point adjacent the short notch to the wear plate outer radius. As another example, a plurality of alternating notches and recesses 210 may be provided. The notches and/or recesses 210 may be spaced apart along the first and/or second direction noted above, or may be spaced along a common diameter of the wear surface 201, some examples of which are shown in FIG. 7(*a*). Clusters of notches and/or recesses 210 may also be provided.

In still another aspect, one or more notches and/or recesses 210 may be provided along a common diameter of the wear plate 200. In particular, it is advantageous to provide one or more notches and/or recesses 210 along an the inner radius $r_I$ of the wear plate so as to provide a flow interrupter at the eye of the wear plate 200 to disturb and dislodge any solids which might remain on the impeller 100 at such point. In this aspect, the notches and/or recesses 210, or portions thereof, are intersected by the inner radius $r_I$ or are otherwise contiguous therewith.

In yet another aspect, the notch(es) and/or recess(es) 210 are configured to have a length L less than a width of a corresponding impeller vane working surface 125, whether such working surface consists only of a conventional vane working surface or comprises a widened vane working surface in accord with the present concepts. Constraining the length L of the notch(es) and/or recess(es) 210 as noted in this example ensures that the notch(es) and/or recess(es) are effectively sealed or closed off by the width of the working surface 125 so that a pathway from the high pressure side of the impeller vane 110 to the lower pressure side of the impeller vane is not created by the notch(es) and/or recess (es). In this particular aspect, the notch(es) and/or recess(es) 210 may extend along the wear surface 201 a first direction perpendicular to predetermined direction of rotation of impeller 100, a second direction having a component crossing against a direction of rotation of the impeller (e.g., counter-clockwise), and/or a third direction having a component in a direction of rotation of the impeller (e.g., clockwise).

In the aforementioned aspects of the disclosed notch(es) and/or recess(es) 210, it is generally preferred that bottom surfaces thereof are at a depth of between about 1/32"–3/8" from the wear plate wear surface 201, and still more preferably between about 1/16"–5/16" from the wear plate wear surface 201. As previously noted, notches 210 may comprise, in a whole or in a part thereof, through-holes extending through the wear surface 201 and/or wear plate 200.

In the illustrated example of FIGS. 7(*a*)–(*b*), the notch(es) and/or recess(es) 210 are substantially oval in shape. However, the shape of the flow interrupters 210 is not limited to the depicted shapes and other shapes are contemplated as being within the scope of the concepts expressed herein including but not limited to a square, rectangle, circle, oval or any oblong form. For example, the wear plate 200 may comprise a plurality of circular notch(es) and/or semi-spherical recess(es) along a wear surface 201 of the wear plate facing the impeller 100 in at least one of the aforementioned first, second, and/or third directions, as applicable to the particular aspect.

Figure 8:
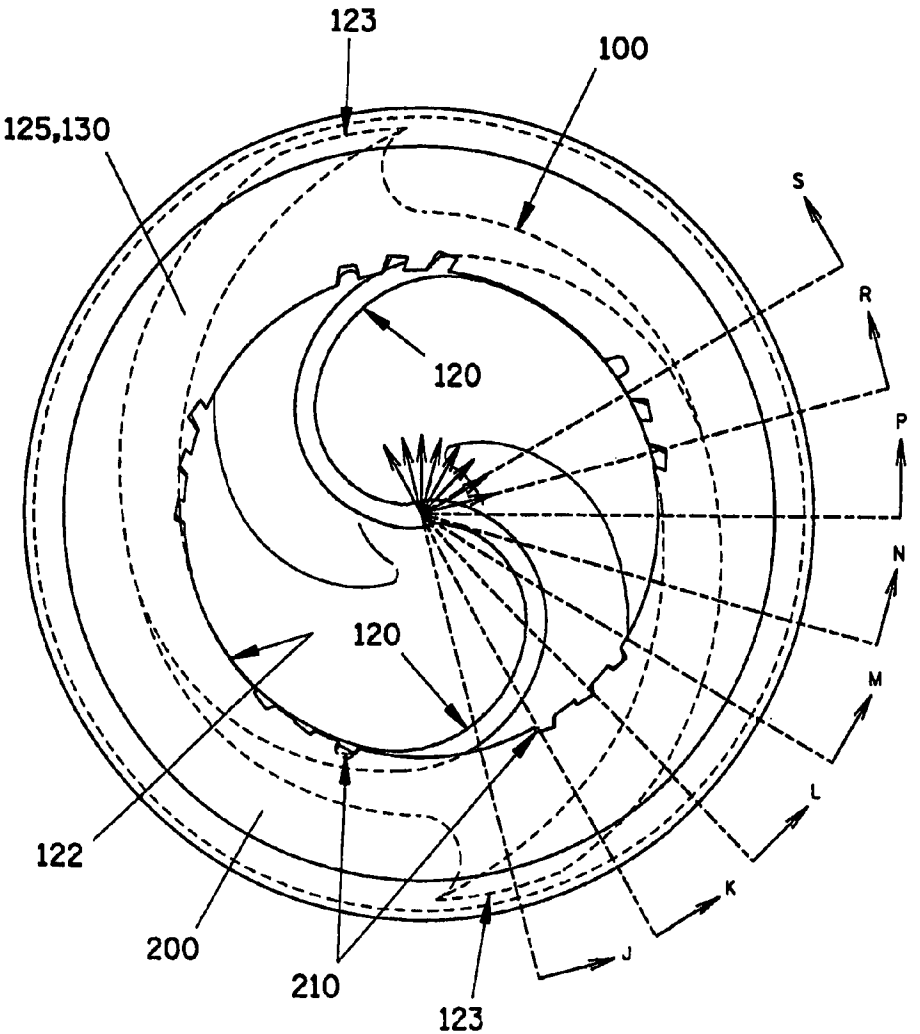
FIG. 8(*a*) is a top view of a combination of the impeller of FIGS. 3(*a*)–3(*d*) and the wear plate of FIG. 7(*a*), showing sectional lines taken along sections J—J through S—S, as shown, and FIGS. 8(*b*)–(*d*) are isometric, first side and second side views of a combination of the impeller of FIGS. 3(*a*)–3(*d*) and the wear plate of FIG. 7(*a*).
Figure 8:
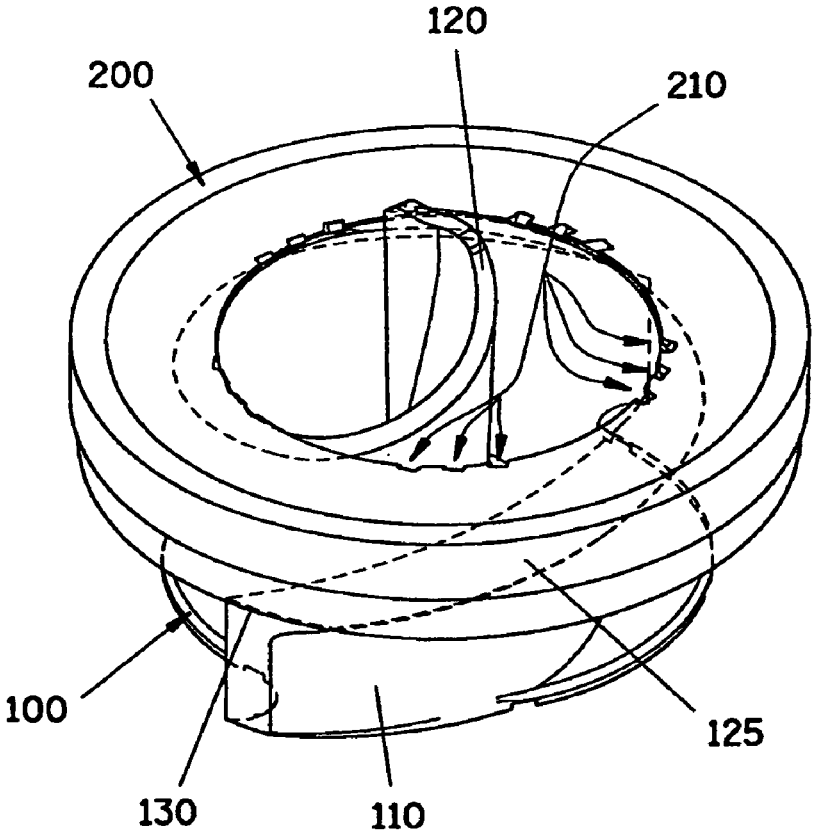
Figure 8:
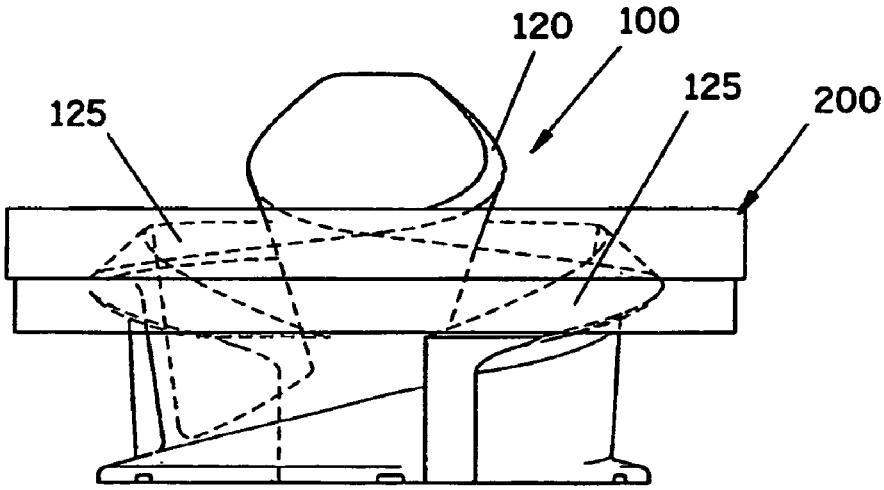
Figure 8:
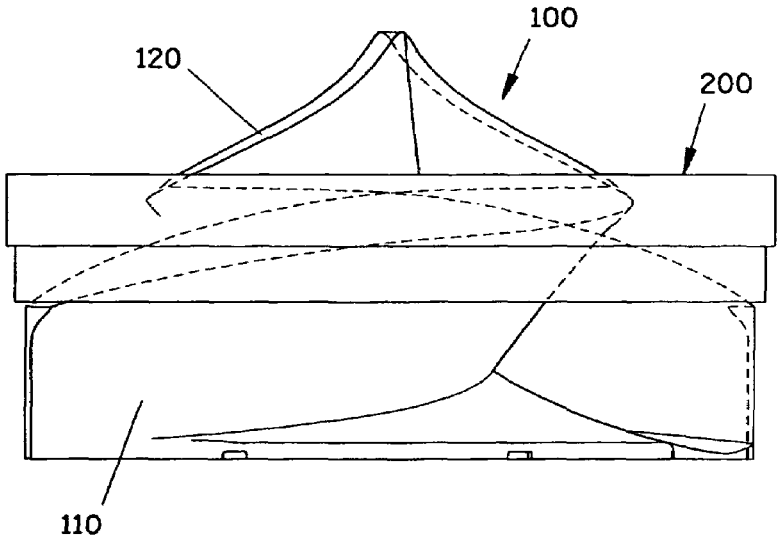

FIGS. 8(*a*)–8(*d*) are top, isometric, first side and second side views of a combination of the impeller of FIGS. 3(*a*)–3(*d*) and the wear plate of FIGS. 7(*a*)–(*b*). FIGS. 8(*a*)–8(*d*) show the spatial relation between the impeller 100 and the wear plate 200 during operation of a centrifugal pump employing the combination. FIG. 8(*a*) shows the radial extent of the impeller to wear plate interface Ilwp, which begins at the aforementioned proximal end 122, wherein the vane 110 intersects the inner radius $IR_w$ of the wear plate 200, and extends outwardly to the distal end 123 of the vane, wherein the vane opposition to the wear plate terminates. Sections J—J, K—K, L—L, M—M, N—N, P—P, R—R, and S—S, of FIG. 8(*a*) are shown in FIGS. 9(*a*)–9(*h*) and are further described below.

Figure 9:
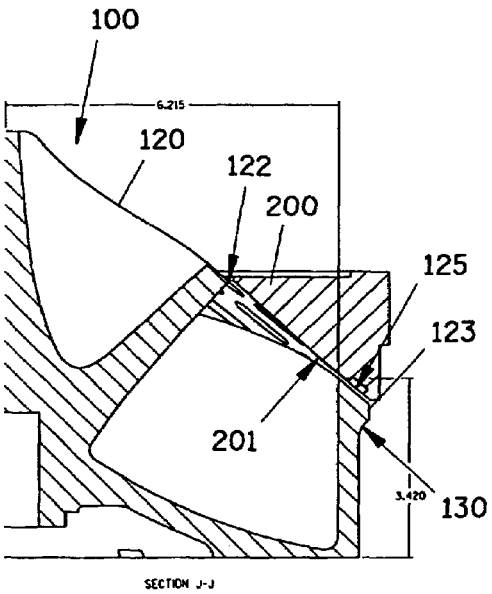
FIGS. 9(*a*)–9(*h*) show sectional views taken along sections J—J through S—S, as shown in FIG. 8(*a*).
Figure 9:
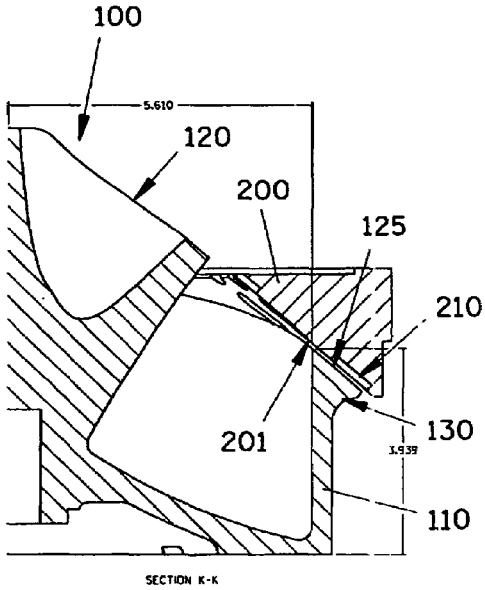
Figure 9:
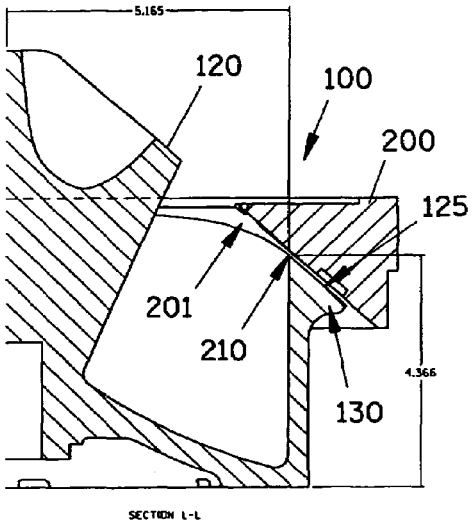
Figure 9:
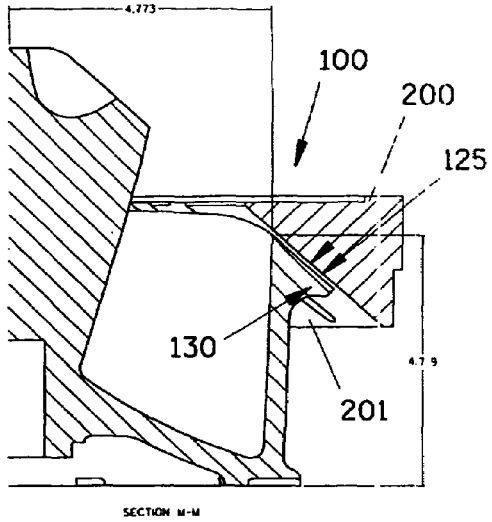
Figure 9:
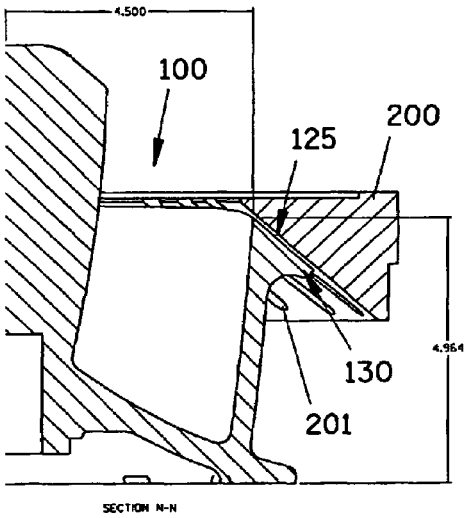
Figure 9:
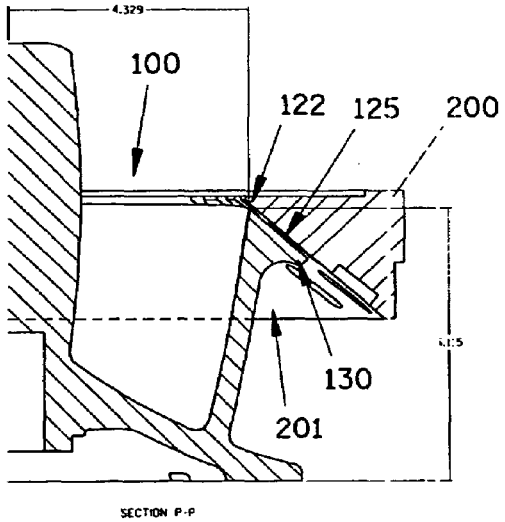
Figure 9:
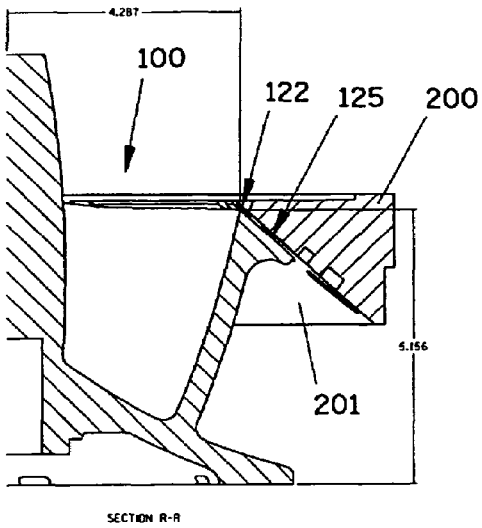
Figure 9:
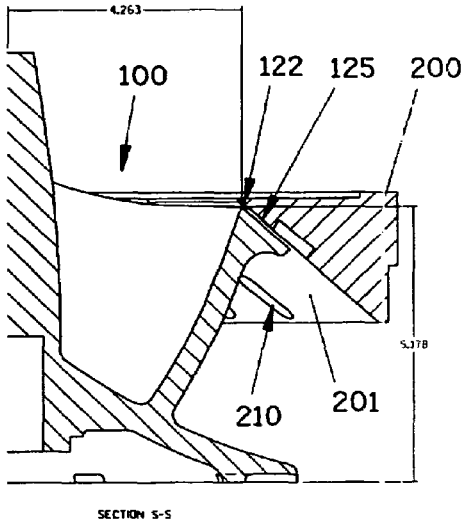

FIGS. 9(*a*)–9(*h*) show cross-sections of a wear plate 200 having an inner wear surface 201 that is conical. As shown in each of FIGS. 9(*a*)–9(*h*), the working surfaces 125 of vane 110, which comprise a front face of flange 130, are provided with an inclination or angle equal to that of wear plate 200 wear surface 201 to form an operational clearance (e.g., between about 0.005"–0.025") therebetween along the entirety of the respective vane wear surface and flange working surfaces so as to permit effective operation of a centrifugal pump into which the depicted combination is disposed. Various flow interrupters 210 are shown in the wear plate 200. In particular, FIG. 9(*b*) shows a flow interrupter 210 having a dimension in cross-section which is less than a corresponding dimension of the impeller working surface 125. Thus, the impeller working surface 125 blocks a path through the flow interrupter 210 from the higher pressure (right) side of the impeller vane 110 to the lower pressure (left) side of the vane.

The concepts disclosed herein can be practiced by employing conventional materials, methodology and equipment. Accordingly, the details of such materials, equipment and methodology are not set forth herein in detail. In the previous descriptions, details of some examples are set forth to provide a grounding in the present concepts to one of ordinary skill in the art. However, it should be recognized that the present concepts can be practiced without resorting to every detail specifically set forth and that the disclosed examples are capable of use in various other combinations and environments. For example, a continuous vane in accord with the present concepts may be coupled with a conventional wear plate. Further, a wear plate in accord with the present concepts may be coupled with a conventional impeller vane. Additionally, a flange in accord with the present concepts could be provided on a conventional vane in combination with a conventional wear plate. Further, the examples disclosed herein are capable of innumerable changes or modifications, such as but not limited to the shapes or groupings of the wear plate notches or the shape and extent of the continuous vane flange, which would still fall within the broad scope of the concepts expressed herein.

What is claimed:

1. A wear plate for use in combination with a centrifugal pump and impeller, comprising:

a wear surface defined by at least one of a substantially flat surface, a truncated conic section, and a curvilinear solid of revolution formed by revolving an area bounded by a curve around a center axis of the wear plate, one of a notch and recess provided in said wear plate wear surface, wherein the notch or recess extends in at least one of a first direction perpendicular to predetermined direction of rotation of an impeller and a second direction crossing against a direction of rotation of said impeller.

2. A wear plate for use in combination with a centrifugal pump and impeller, according to claim 1, wherein said second direction ranges from said first direction up to and including a direction opposite said direction of rotation.

3. A wear plate for use in combination with a centrifugal pump and impeller according to claim 1, wherein the notch or recess extends along a longitudinal direction of said wear plate between an inner first radius of said wear plate and an outer second radius.

4. A wear plate for use in combination with a centrifugal pump and impeller according to claim 1, wherein the notch or recess extends from an inner first radius of said wear plate to an outer second radius of said wear plate.

5. A wear plate for use in combination with a centrifugal pump and impeller according to claim 1, wherein said wear plate comprises a plurality of spaced apart notches or recesses.

6. A wear plate for use in combination with a centrifugal pump and impeller according to claim 5, wherein at least some of said plurality of spaced apart notches or recesses are disposed along a longitudinal direction of said wear plate between an inner first radius of said wear plate arid an outer second radius in at least one of said first direction and said second direction.

7. A wear plate for use in combination with a centrifugal pump and impeller according to claim 6, wherein at least some of said plurality of spaced apart notches or recesses are spaced apart laterally along said wear surface of said wear plate.

8. A wear plate for use in combination with a centrifugal pump and impeller according to claim 5, wherein at least one of said plurality of spaced apart notches or recesses are contiguous with said inner first radius.

9. A wear plate for use in combination with a centrifugal pump and impeller according to claim 5, wherein a plurality of said spaced apart notches or recesses are contiguous with said inner first radius.

10. A wear plate for use in combination with a centrifugal pump and impeller according to claim 7, wherein said plurality of spaced apart notches are arranged in spaced apart groupings of plural notches.

11. A centrifugal pump impeller, comprising:

at least one vane disposed on said impeller:

a flange forming at least a portion of a working surface of said vane at an impeller to wear plate interface and extending toward a high-pressure side of said vane, wherein said vane comprises a curvilinear and continuous vane extending from one edge of the centrifugal pump impeller through a central portion of the impeller to another opposing edge of the impeller.

12. A centrifugal pump impeller according to claim 11, wherein a leading edge of said curvilinear and continuous vane has, at least in a vicinity of a midpoint of said impeller, a substantially constant thickness.

13. A centrifugal pump impeller according to claim 12, wherein said vane is symmetric.

14. A centrifugal pump impeller according to claim 12, wherein a height of said leading edge relative to a bottom of said impeller increases continuously from an outer radius of said leading edge to central region of said impeller.

15. A centrifugal pump impeller, comprising:

at least one vane disposed on said impeller;

a flange forming at least a portion of a working surface of said vane at an impeller to wear plate interface and extending toward a high-pressure side of said vane, wherein said flange has an upper surface defining an acute angle with a parallel to an axis of rotation of said impeller and a curved bottom portion.

16. A centrifugal pump impeller according to claim 15, wherein said curved bottom portion has an angle β ranging between 180° and about 0°.

17. A centrifugal pump impeller according to claim 15, wherein said curved bottom portion has an angle β ranging between about 110° to 70°.

18. A centrifugal pump, comprising:

an impeller configured to rotate in a predetermined direction of rotation within said centrifugal pump; and a wear plate hearing a wear surface disposed opposite and adjacent said impeller, and one of a notch and recess provided in said wear surface, wherein the notch or recess extends in at least one of a first direction perpendicular to predetermined direction of rotation of said impeller and a second direction crossing against a direction of rotation of said impeller.

19. A centrifugal pump, according to claim 18, wherein said second direction ranges from said first direction up to and including a direction opposite said direction of rotation.

20. A centrifugal pump according to claim 18, wherein the notch or recess extends along a longitudinal direction of said wear plate between an inner first radius of said wear plate and an outer second radius.

21. A centrifugal pump according to claim 18, wherein the notch or recess extends from an inner first radius of said wear plate to an outer second radius of said wear plate.

22. A centrifugal pump according to claim 19, wherein said wear plate comprises a plurality of spaced apart notches or recesses.

23. A centrifugal pump according to claim 22, wherein at least some of said plurality of spaced apart notches or recesses are disposed along a longitudinal direction of said wear plate between an inner first radius of said wear plate and an outer second radius in at least one of said first direction and said second direction.

24. A centrifugal pump according to claim 22, wherein at least some of said plurality of spaced apart notches or recesses are spaced apart laterally along said wear surface of said wear plate.

25. A centrifugal pump according to claim 19, wherein at least one of said plurality of spaced apart notches or recesses are contiguous with said inner first radius.

26. A centrifugal pump according to claim 25, wherein a plurality of said spaced apart notches or recesses are contiguous with said inner first radius.

27. A centrifugal pump according to claim 26, wherein said plurality of spaced apart notches are arranged in spaced apart groupings of plural notches.

28. A centrifugal pump according to claim 18, wherein said impeller comprises a curvilinear continuous vane extending from one edge of the impeller through a center portion of the impeller to another opposing edge of the impeller.

29. A centrifugal pump according to claim 18, wherein said impeller comprises at least one vane having a flange provided at a working surface of said vane to form at least a portion of an impeller to wear plate interface and extending toward a high-pressure side of said vane.

30. A centrifugal pump according to claim 29, wherein said vane comprises a curvilinear and continuous vane extending from one edge of the centrifugal pump impeller through a central portion of the impeller to another opposing edge of the impeller.

31. A centrifugal pump according to claim 30, wherein said vane is symmetric.

32. A centrifugal pump according to claim 31, wherein said flange is provided on substantially an entire working surface of said vane.

33. A centrifugal pump according to claim 31, wherein said flange is provided on a portion of a working surface of said vane.

34. A centrifugal pump according to claim 31, wherein said flange has an upper surface defining an acute angle with a parallel to an axis of rotation of said impeller and a curved bottom portion.

35. A centrifugal pump according to claim 34, wherein said curved bottom portion has an angle β ranging between 180° and about 0°.

36. A centrifugal pump according to claim 34, wherein said curved bottom portion has an angle β ranging between about 110° to 70°.

37. A centrifugal pump, comprising:

an impeller configured to rotate in a predetermined direction of rotation within said centrifugal pump, said impeller having at least one vane; and a wear plate bearing a wear surface disposed opposite and adjacent said impeller, and one of a notch and recess having a first width provided in said wear surface, wherein the notch or recess extends in at least one of a first direction perpendicular to predetermined direction of rotation of an impeller, a second direction having a component crossing against a direction of rotation of the impeller, and a third direction having a component in a direction of rotation of the impeller, wherein said vane comprises a flange provided at a working surface of said vane to form at least a portion of an impeller to wear plate interface having a second width and extending toward a high-pressure side of said vane, and wherein said second width is greater than said first width.

38. A centrifugal pump according to claim 37, wherein said vane comprises a curvilinear and continuous vane extending from one edge of the centrifugal pump impeller through a central portion of the impeller to another opposing edge of the impeller.

39. A centrifugal pump according to claim 38, wherein said vane is symmetric.

40. A centrifugal pump according to claim 37, wherein said flange is provided on substantially an entire working surface of said vane.

41. A centrifugal pump according to claim 37, wherein said flange is provided on a portion of a working surface of said vane.

42. A centrifugal pump according to claim 37, wherein said flange has an upper surface defining an acute angle with a parallel to an axis of rotation of said impeller and a curved bottom portion.

43. A centrifugal pump according to claim 42, wherein said curved bottom portion has an angle β ranging between 180° and about 0°.

44. A centrifugal pump according to claim 42, wherein said curved bottom portion has an angle β ranging between about 110° to 70°.

45. A wear plate for use in combination with a centrifugal pump and impeller according to claim 37, wherein said wear plate comprises a plurality of spaced apart notches or recesses.

46. A wear plate for use in combination with a centrifugal pump and impeller according to claim 45, wherein at least some of said plurality of spaced apart notches or recesses are disposed along a longitudinal direction of said wear plate between an inner first radius of said wear plate and an outer second radius in at least one of said first direction and said second direction.

47. A wear plate for use in combination with a centrifugal pump and impeller according to claim 45, wherein at least some of said plurality of spaced apart notches or recesses are spaced apart laterally along said wear surface of said wear plate.

48. A wear plate for use in combination with a centrifugal pump and impeller according to claim 45, wherein at least one of said plurality of spaced apart notches or recesses are contiguous with said inner first radius.

49. A wear plate for use in combination with a centrifugal pump and impeller according to claim 45, wherein a plu rality of said spaced apart notches or recesses are contiguous with said inner first radius.

50. A centrifugal pump impeller, comprising:

at least one vane disposed on said impeller, said vane comprising a curvilinear and continuous vane extending from one edge of the centrifugal pump impeller through a central portion of the impeller to another opposing edge of the impeller, wherein a leading edge of said curvilinear and continuous vane has, at least in a vicinity of said central portion of said impeller, a substantially constant thickness, wherein said vane is symmetric, and wherein a height of said leading edge relative to a bottom of said impeller increases continuously from an outer radius of said leading edge to said central portion of said impeller.

* * * * *